US006392604B1

(12) United States Patent
Bohannan

(10) Patent No.: US 6,392,604 B1
(45) Date of Patent: May 21, 2002

(54) ANTENNA DEVICE COMPRISING SLIDING CONNECTOR MEANS

(75) Inventor: Richard Bohannan, Långås (SE)

(73) Assignee: Allgon AB, Åkersberga (SE)

( * ) Notice: Subject to any disclaimer, the term of this patent is extended or adjusted under 35 U.S.C. 154(b) by 0 days.

(21) Appl. No.: 09/744,967

(22) PCT Filed: Aug. 19, 1999

(86) PCT No.: PCT/SE99/01411

§ 371 Date: Feb. 13, 2001

§ 102(e) Date: Feb. 13, 2001

(87) PCT Pub. No.: WO00/11748

PCT Pub. Date: Mar. 2, 2000

(30) Foreign Application Priority Data

Aug. 19, 1998 (SE) ..... 9802772

(51) Int. Cl.[7] ..... H01Q 1/24

(52) U.S. Cl. ..... 343/702; 343/906; 343/901

(58) Field of Search ..... 343/702, 895, 343/901, 900, 906, 725, 729; H01Q 1/24

(56) References Cited

U.S. PATENT DOCUMENTS 5,949,377 A * 9/1999 Matsumoto et al. ..... 343/702

FOREIGN PATENT DOCUMENTS

| | | | | |
|---|---|---|---|---|
| EP | 487053 A1 | * | 5/1992 | ..... H01Q/1/38 |
| EP | 0776061 A2 | * | 5/1997 | ..... H01Q/1/24 |
| WO | 16980 | * | 10/1992 | ..... H01Q/1/24 |
| WO | 02622 | * | 1/1997 | ..... H01Q/1/24 |
| WO | 09342 | * | 3/1998 | ..... H01Q/1/24 |
| WO | 15029 | * | 4/1998 | ..... H01Q/1/24 |

* cited by examiner

*Primary Examiner*—Hoanganh Le
(74) *Attorney, Agent, or Firm*—Jacobson Holman, PLLC

(57) ABSTRACT

The present invention relates to problems with how to achieve a reliable and efficient connection between circuitry in a radio communication device and an extendable and retractable antenna device, which is operable in both extended and retracted position as well as during extension and retraction. This problem is solved by providing an antenna device with radiating means, movable between an extended and a retracted position. The antenna device having a feeding arrangement comprising at least a first connection member (306, 307, 308; 801, 802, 803) electrically coupled to and movable with the radiating means. The feeding arrangement further comprises at least a second connection member (309, 310; 903, 904, 905, 906, 907; 1003, 1004, 1005) arranged for being electrically coupled to the first circuitry and fixedly mounted on a support unit. Moreover, the first connection member being electrically coupled to the second connection member in all positions between and including the extended and retracted positions.

13 Claims, 9 Drawing Sheets

ANTENNA DEVICE COMPRISING SLIDING CONNECTOR MEANS

TECHNICAL FIELD OF INVENTION

The present invention relates in general to an antenna device, for receiving and transmitting RF signals with .a sliding connector means, and more specifically to an antenna device for receiving and transmitting RF signals, which is electrically coupled to radio circuitry through a sliding connector during its extension and retraction.

DESCRIPTION OF RELATED ART

Some of the driving forces of the mobile communication industry today are availability and size. A user of a hand-held mobile communication device requires to be reached wherever his location may be. This puts requirements on the operator to have good coverage of their mobile network, but for large unpopulated or scarcely populated areas, this is not possible with any reasonable economy. One solution for a user who frequently travels to unpopulated locations is to instead use a satellite communication telephone.

Such a user will still have requirements on the size of his satellite communication device, as he undoubtedly will compare his ordinary cellular communication device with his satellite communication device. Since the distance to orbiting or stationary satellites is so great, satellite antennas need to be able to handle very weak signals. The antennas used will thus generally be larger and require less obstacles compared to antennas for cellular communication devices, and will consequently take a considerable amount of the space of a satellite communication device. The need for reducing the size of the antennas for satellite communication devices is thus large and anyone being able to reduce the size for such an antenna will have a considerable competitive advantage.

The somewhat larger antenna unit in a satellite communication device has posed some problems. In one set of prior art antennas the antenna unit can be rotated around an axis so as to fold the antenna unit along one side of the satellite communication device when not in talk position. Thereby, the space taken by the terminal device is considerably less when in a standby mode. One problem, which occurs with this solution, is that the antenna is badly suited to receive paging signals from the satellite in the standby mode. This can be remedied by introducing an extra paging antenna on the top of the satellite communication device specifically designed for receiving signaling in the standby mode. This, however generates a new problem namely with how to switch between the different antennas in dependence of the operating mode.

Another solution requires the satellite device to have a specific position during standby, such as upside down. The U.S. patent application Ser. No. 5,628,057 discloses a satellite communication device with an antenna unit connected thereto at a pivot point.

SUMMARY OF INVENTION

The object of the present invention is thus to achieve a reliable and efficient connection between circuitry in a radio communication device and an extendable and retractable antenna device, which is operable in both extended and retracted position.

Another object of the present invention is to achieve a reliable and efficient connection between circuitry in a radio communication device and an extendable and retractable antenna device, which is operable during extension and retraction.

The problems described above, how to achieve a reliable and efficient connection between circuitry in a radio communication device and an extendable and retractable antenna device, which is operable in both extended and retracted position as well as during extension and retraction, is solved by providing an antenna device with radiating means, movable between a extended and a retracted position. Said antenna device having a feeding arrangement comprising at least a first connection member electrically coupled to and movable with said radiating means. Said feeding arrangement further comprises at least a second connection member arranged for being electrically coupled to said first circuitry and fixedly mounted on a support unit. Moreover, said first connection member being electrically coupled to said second connection member in all positions between and including said extended and retracted positions.

In more detail the objects of the present invention are obtained, according to a first embodiment, by providing an antenna device according to the above, wherein said first connection member comprises a multitude of resilient conductive members. Said second connection member comprising a multitude of elongated conductive strips arranged on one side of a dielectric medium and with a ground plane arranged on an opposite side of said dielectric medium. Each resilient conductive member of said multitude of conductive members being arranged to exert a force against a corresponding elongated conductive strip so as to enable electrical coupling between said conductive member and said conductive strip. Each resilient conductive member being arranged to slide along said elongated conductive strip when said radiating means moves between said first and second positions.

According to another embodiment, the objects of the present invention are obtained by providing an antenna device according to the above, wherein said antenna device further comprises a switch. Said switch being arranged for disconnecting said second connection member and connecting said first circuitry to said radiating means when said radiating means is in said second position.

According to another embodiment, the objects of the present invention are obtained by providing an antenna device according to the above, wherein at least one of said elongated conductive strips having irregular shaped edges. Said irregular shaped edges being adjusted so that the elongated conductive strip having an input impedance, seen from a first point where the resilient conductive member connects to the elongated conductive strip when said radiating element is in extended position, and towards said open end which is very large compared to the input impedance seen from said first points and towards the radiating means. These irregular shaped edges can for instance be obtained by protrusions and/or recesses.

An advantage with the present invention is that a reliable connection between the circuitry in a radio communication device and an extendable radiating means is obtained in extended and retracted position as well as during extension and retraction.

Another advantage with the present invention is that the shortest possible electrical transmission distance is kept between the radiating element and the radio circuitry in both extended and retracted position.

An advantage, according to one embodiment of the invention, is that several independent, electrically separate connections between circuitry in a radio communication device and an extendable radiating means can be obtained easily and reliably.

An advantage, according to one embodiment of the invention, is that power and control signals can easily and reliably be fed to circuitry located on the radiating means.

An advantage, according to one embodiment of the invention, is that transmitted and received signals can be conducted on separate lines between the radiating means and the circuitry in the radio communication device.

An advantage, according to one embodiment of the invention, is that signals to different radiating elements, arranged for receiving and transmitting RF signals in different systems can be conducted on separate lines between the radiating means and the circuitry in the radio communication device.

Another advantage, according to one embodiment of the invention, is that said elongated conductive strip may have irregular shaped edges, such as protrusions or recesses, so that the elongated strip is to be regarded as an open circuit when said radiating means is in its extended position.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings, which are given by way of illustration only, and thus are not limitative of the present invention and wherein.

DETAILED DESCRIPTION OF PREFERRED EMBODIMENTS

Figure 1:
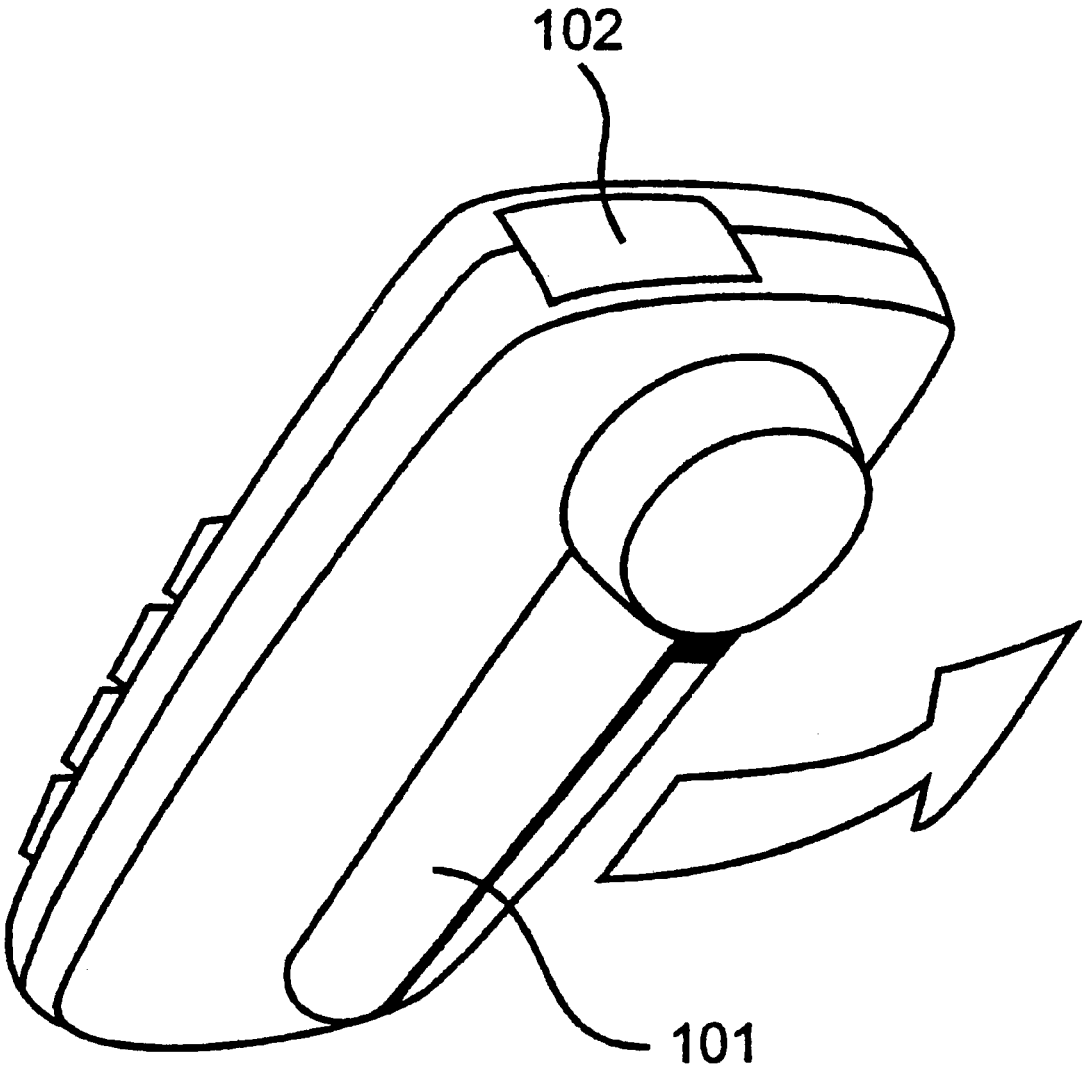
FIG. 1 shows an prior art antenna arrangement for a satellite communication terminal having a rotatable main antenna and an auxiliary antenna.

FIG. 1 shows a radio communication device with a prior art antenna 101 for satellite communication. The antenna 101 is mounted on the backside of the radio communication device at a pivot point and can thus be rotated to an active position, pointing essentially upwards, or to an inactive position, pointing essentially downwards. A patch antenna 102 is mounted on top of the radio communication device for receiving paging signals when the primary antenna 101 is in an inactive position.

The patch antenna 102 can be avoided if the radio communication device is positioned up side-down. The primary antenna 101 would then be pointing essentially upwards, towards the communication satellite, and would be able to receive paging signals.

If an extra antenna unit or awkward positioning requirements is to be avoided an extendable antenna unit may be used instead. With an extendable and retractable antenna unit, the same antenna unit may be used for paging signals as well as for use in talk position.

Figure 2:
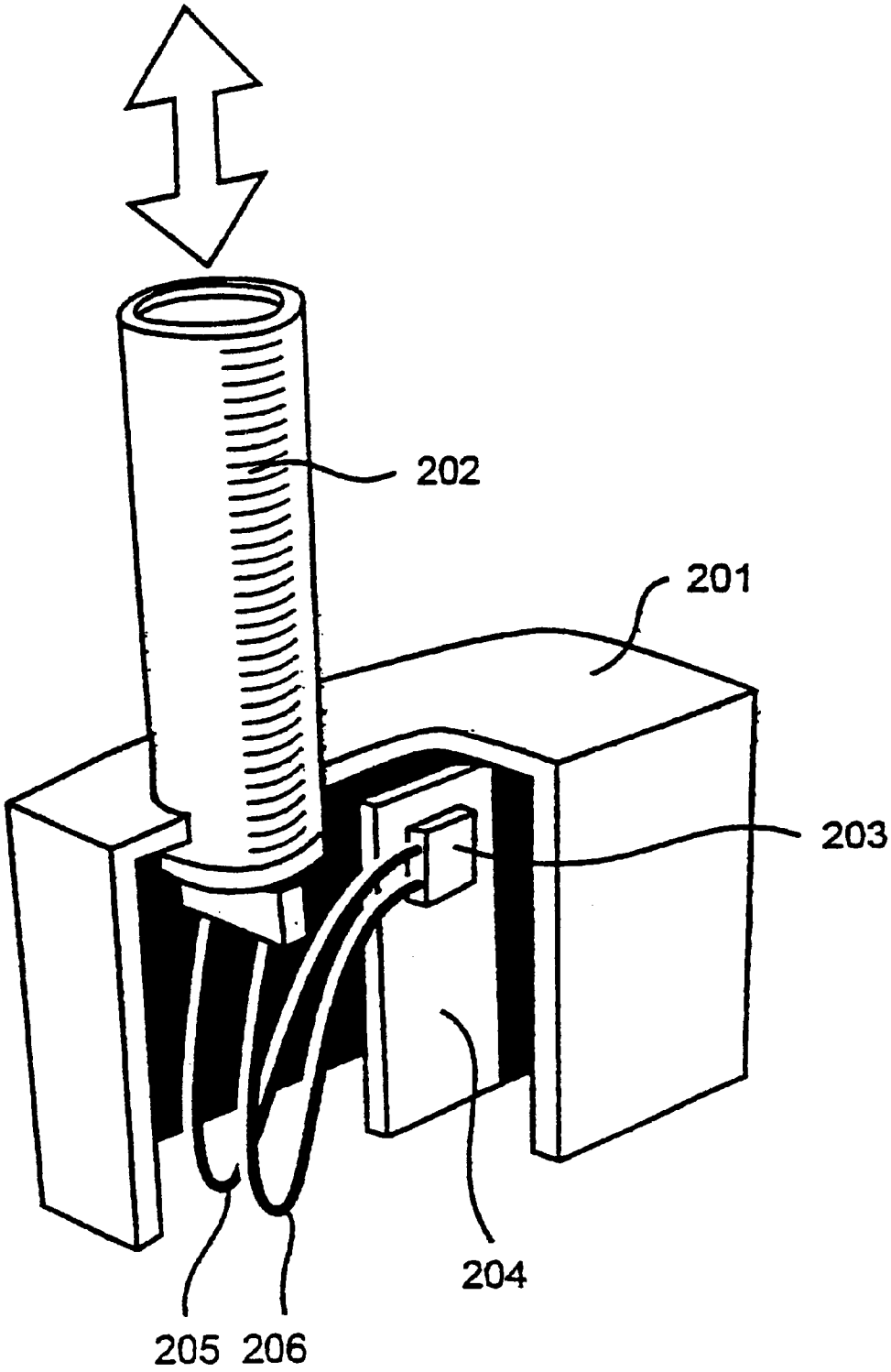
FIG. 2 shows an axially extendable antenna means connected with coaxial cables to the circuitry of a radio communication device.

FIG. 2 shows a radio communication device 201 with extendable radiating means 202. The radiating means is connected to circuitry 203 mounted on a printed circuit board PCB 204 in the radio communication device 201. The connection is achieved with a first coaxial cable 205 and a second coaxial cable 206.

During manufacturing, the use of coaxial cables would introduce some problems. It is difficult to mount the cable connection to the connections in the circuitry and the radiating means in an efficient manner. If several different connections between the radiating means 202 and the circuitry 203 is needed each new coaxial cable increase the difficulties in the manufacturing process. Therefore is the use of coaxial cable connections a feasible but a cumbersome and expensive solution. The connections and the cable will also introduce unnecessary losses in the transmission of signals between the circuitry 203 and the radiating means 202. This has its greatest disadvantage when the radiating element is in its extended position and the geometric distance between the circuitry and the radiating element is relatively short but the distance using coaxial cables is still relatively long.

Figure 3:
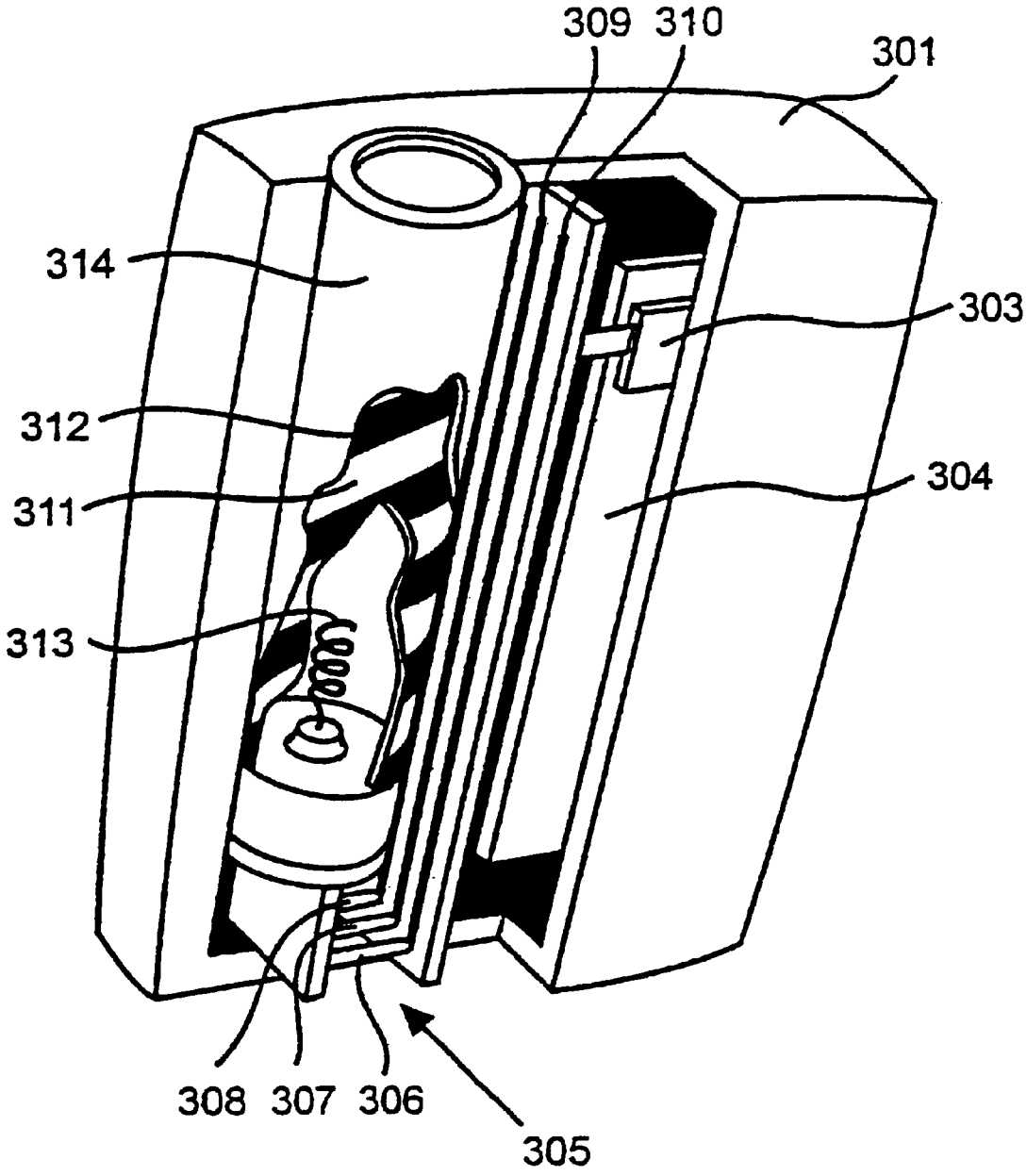
FIG. 3 shows a perspective view of an antenna device and radio communication device according to a first embodiment of the invention.

FIG. 3 shows a radio communication device 301 with a radiating means 302 and circuitry 303 mounted on a PCB 304. Feeding arrangement 305 being arranged for feeding signals from the circuitry 303 to the radiating means 302. Said feeding arrangement 305 comprises first, second and third connection members denoted 306, 307 and 308 respectively, and fourth, fifth and sixth connection members denoted 309, 310 and 311.

The first, second and third connector member are so called pogo pins, telescoping contacts with spring action, mounted on, and movable with the radiating means 302. The fourth, fifth and sixth connector members are elongated conductive strips mounted on a dielectric medium with conductive backside coupled to ground and fixedly attached to the casing of the radio communication device. The casing thus act as a support member to the elongated conductive strips. The pogo pins 306, 307 and 308 are resilient, spring loaded and exert a force on elongated conductive strips 309, 310 and 311 so as to enable electrical coupling between the first and fourth, the second and fifth and the third and sixth connector member, respectively. Thus, electrical coupling is achieved between the circuitry 303 and the radiating means 302 when the radiating means is in retracted and extended position as well as in all positions between. For RF signals the transmission characteristics of the transmission line from the circuitry to the radiating element via the connector members will vary during extension and retraction as disclosed in FIG. 6.

Figure 6:
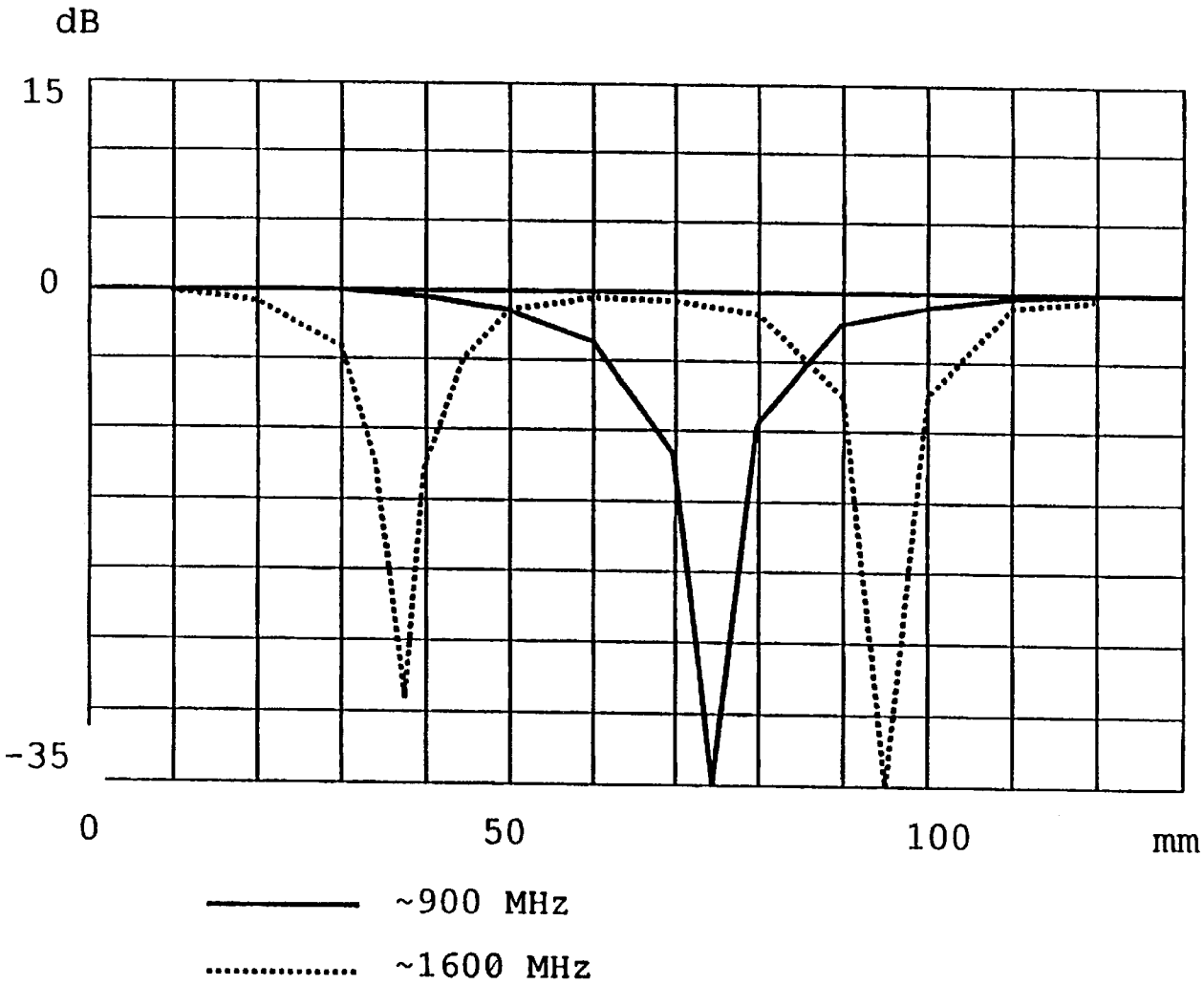
FIG. 6 shows a schematic signal strength diagram during the extension of the inventive antenna means according to one embodiment of the invention, FIG. 7 schematically shows the inventive antenna device according to a third embodiment of the invention.

In FIG. 6 is the damping of the signal plotted against the distance the antenna is injected into the well of the portable phone for two different frequencies. As can be seen in FIG. 6 one dip occurs for the 90.0 MHz frequency and two dips occur for the 1600 MHz frequency. The dip in transmission efficiency will not have a substantial adverse effect of the performance of the communication since the communication system is designed for allowing short breaks in transmission. Of course, for signals which is not RF signals, such as power and control signals, no such dips in transmission will occur.

The radiating means further comprises a first radiating element 312. The first radiating element consists of a number N, where N being an integer, greater than 1, of conductive, helical strips arranged for receiving and transmitting circular polarized RF signals. It would of course also be possible to use any other radiating means suitable for receiving and transmitting circular polarized RF signals, such as helical conductive wires. The first radiating element 312 is connected, through a phasing network, to the first connector member 306 and further through the fourth connector member 309 to the circuitry 303.

A second radiating element is denoted 313 and is arranged for receiving and transmitting planar polarized RF signals such as is used for earth based radio communication, for instance GSM, DECT, AMPS, DAMPS, PCS etc. The second radiating element is connected to the third connector member 308 and further through the sixth connector member 311 to the circuitry 303.

A protective cap is denoted 314 and is only partly shown for sake of clarity. The cap 314 also comprises guiding protrusions (not shown) which connects with corresponding guiding surfaces positioned on the surrounding walls (not shown). Alternatively, the guiding profiles may be positioned on a support, arranged for supporting the first radiating element 312.

Figure 4:
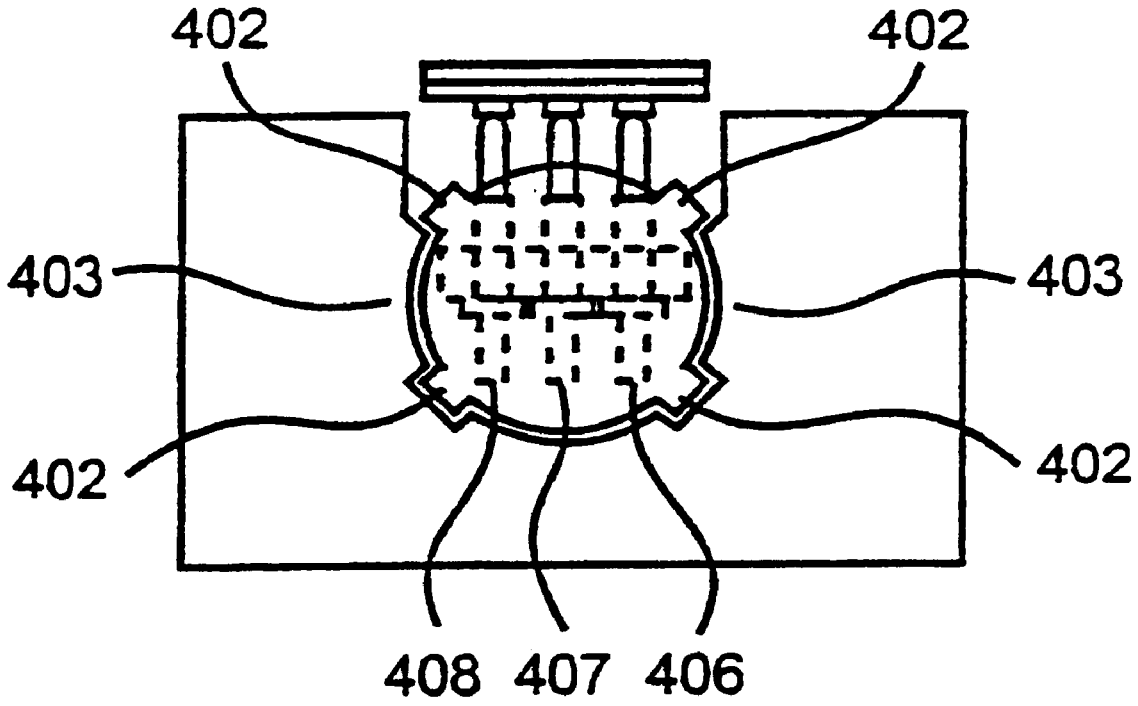
FIG. 4 shows a detailed view of the connector member according to the first embodiment of the invention, FIGS. 5*a*, 5*b* and 5*c* schematically shows different electrical configurations according to a preferred embodiment of the invention.

FIG. 4 shows a top view of the radiating means 302 and more clearly discloses a well from which the radiating means 302 is extendable and retractable. Guiding protrusions 402 engage guiding surfaces 403 so that a sliding movement of the radiating means 302 is possible. This makes it possible to extend the radiating means 302 out of the well and retract said means back into the well again.

Figure 12:
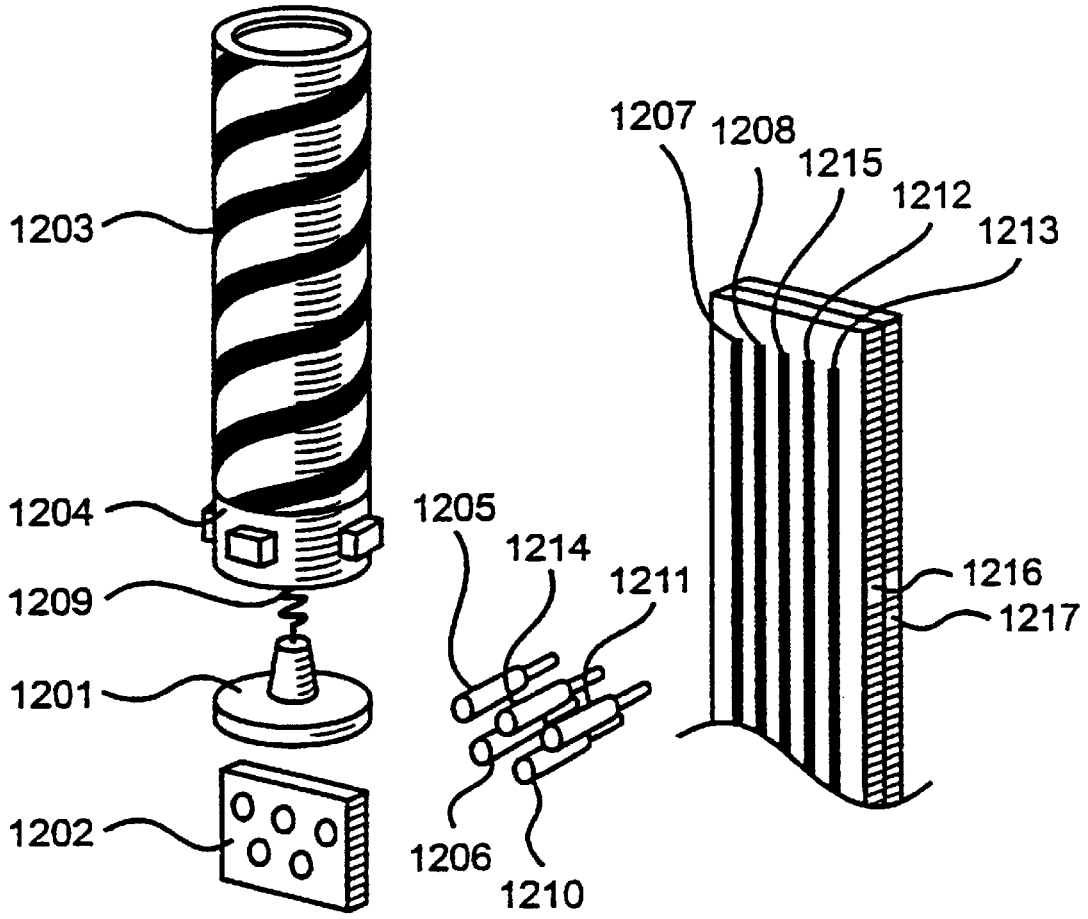

FIG. 12 shows an exploded view of the main components according to one embodiment of the invention. In this embodiment five different connections are used between the radiating means and the circuitry in a radio communication device. A first PCB is denoted 1201 and a second PCB is denoted 1202. A first radiating element is denoted 1203 and is consisting of a number of helically wounded conductive strips on a thin flexible carrier mounted on a hollow support 1204. Said first radiating element is arranged for receiving and transmitting circular polarized RF signals mainly for communication with a satellite. Said first radiating element 1203 is coupled to a phasing network and a diplexer (not shown) when necessary. The phasing network being arranged to transform circularly polarized RF signals to and from signals suitable for transmission to circuitry in a radio communication device. The diplexer separates received signals $R_x$ and transmitted signals $T_x$ into two separate signals carried on two separate conductors, alternatively two separate phasing networks can be utilized for the transmission frequency $T_x$ and the receiving frequency $R_x$. The $T_x$ and $R_x$ signals are connected to a first and second connector member 1205 and 1206 respectively, which in turn are coupled to third and fourth connector member 1207 and 1208 respectively. Said third and fourth connector members 1207 and 1208 being further connected to circuitry in a radio communication device. On the connection established over said first and third, and second and fourth connector members is also power and control signals, for instance to a LNA (Low Noise Amplifier), conducted to the phasing network and the diplexer positioned on the first or second PCB 1201, 1202. Alternatively may separate connector members be used for the transfer of power and control signals to the phasing network and diplexer.

A second radiating element is denoted 1209 and is a helical conductive coil arranged for receiving and transmitting RF signals in for instance the GSM, DECT or AMPS systems. The second radiating element is positioned inside the support 1204 and is connected to circuitry in a radio communication device through fifth, sixth, seventh and eighth connector members denoted 1210, 1211, 1212 and 1213 in a similar way as was described for said first radiating element. However, no phasing network or diplexers are generally required. Ninth and tenth connector members denoted 1214 and 1215 are used for carrying signal ground from the circuitry. Said second, fourth, sixth, eight and tenth connector members are mounted on a dielectric medium or carrier 1216 which on the backside has a ground plane 1217.

It would of course also be possible to have separate signal ground strips between every signal carrying strip, or several signal ground strips surrounding on signal strip etc.

One advantage with using strips compared to coaxial connections is that loss in connections and transmission is significantly reduced.

Figure 5A:
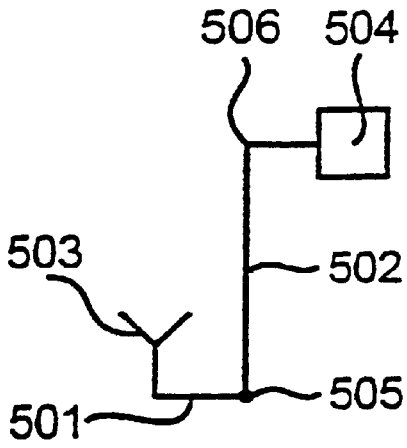
Figure 5B:
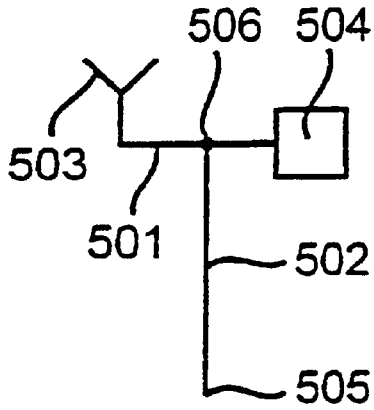
Figure 5C:
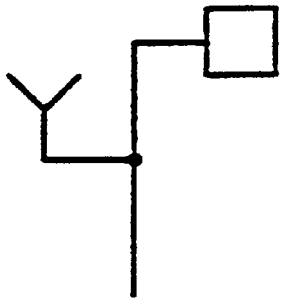

FIGS. 5*a*, 5*b* and 5*c* shows schematic circuit diagrams of different configurations according to a preferred embodiment of the invention. With 501 is a first connector member denoted and with 502 is a second connector member denoted. With 503 is a radiating means denoted and 504 denote a circuitry in a radio communication device. Even though, for sake of clarity, only one line is drawn in FIG. 5 between the circuitry 504 and the radiating means 503 it is to be understood, as been shown above, that this line may represents two or more elongated conductive strips and connectors constituting a transmission line. Said second connector member 502 has a first end denoted 505 and a second end 506 connected to said circuitry 504.

As disclosed in FIG. 5*a*, when the radiating means is in its retracted position the second connector member 502 electrically connects the radiating means 503 to the circuitry 504. In FIG. 5*b* the radiating means 503 is shown in its extended position connected to the circuitry 504. The first end 505 is in this position an open end. In FIG. 5*b* the electrical length of the second connector member 502 is selected so that the second connector member 502 has very high impedance at the second end 506 compared to the radiating means 503, for the selected frequency band, and can therefore be regarded as a open circuit. In FIG. 5*c*, the radiating means 503 is disclosed in a position between the extended and the retracted position. The radiating means 503 is still coupled to the circuitry 504 through said first and second connector members.

Figure 7:
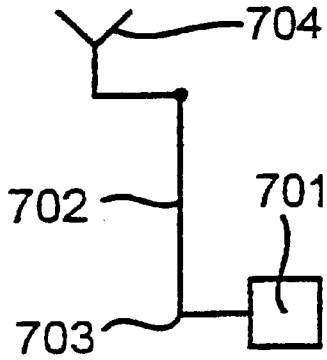

FIG. 7 shows an arrangement where circuitry 701 is connected to second connector member 702 at the first end 703. When the radiating means 704 is in its retracted position the second connector member 702 is an open stub and may be disconnected with a switch (not shown) or adjusted to high input impedance as described above.

Figure 8A:
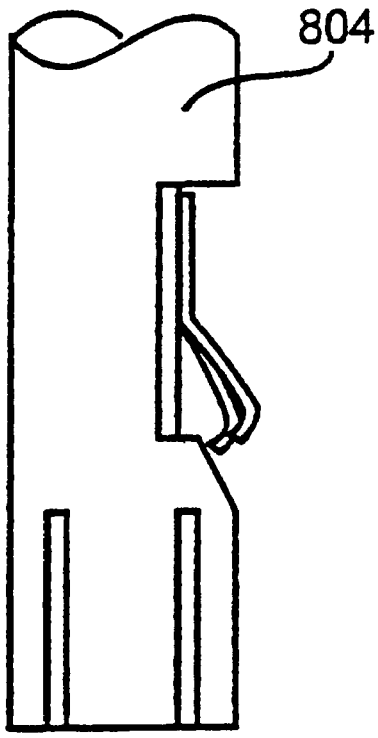
FIGS. 8*a*, 8*b* and 8*c* shows a detailed view of a connector member according to a fourth embodiment of the invention.
Figure 8B:
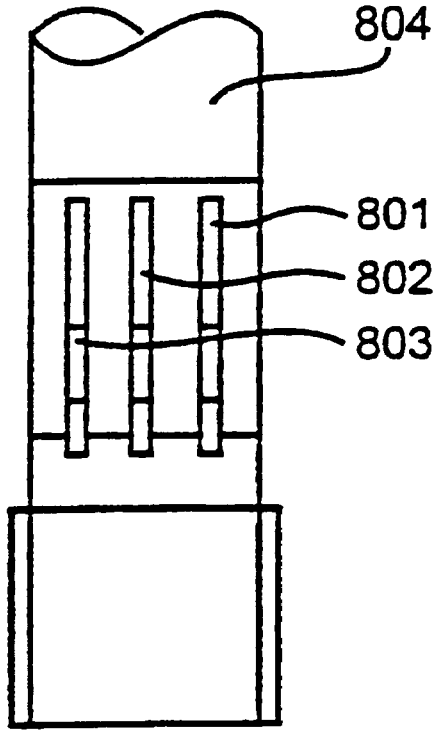
Figure 8C:
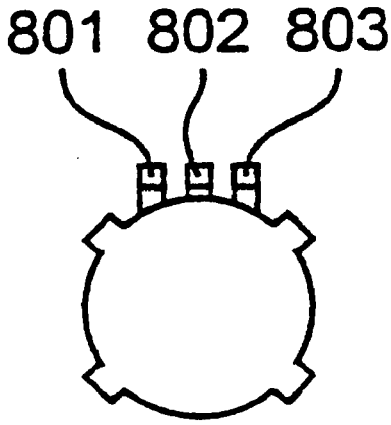

FIG. 8*a* shows a side view, FIG. 8*b* shows a front view and, FIG. 8*c* shows a top view of connector members,801, 802 and 803 where flexible, wire members are used. A radiating means is denoted 804, on and/or in the support is radiating elements mounted (not shown). As the radiating means 804 is extended or retracted, the resilient members 801, 802 and 803 will glide on elongated connector members (not shown). As is shown in FIG. 8*a* the resilient connector members 801, 802 and 803 is flexible and will exert a force on the elongated connector members so as to enable electrical contact. In FIG. 8*a* one wire member is shown depressed to indicate the flexibility of the wire members.

Figure 9A:
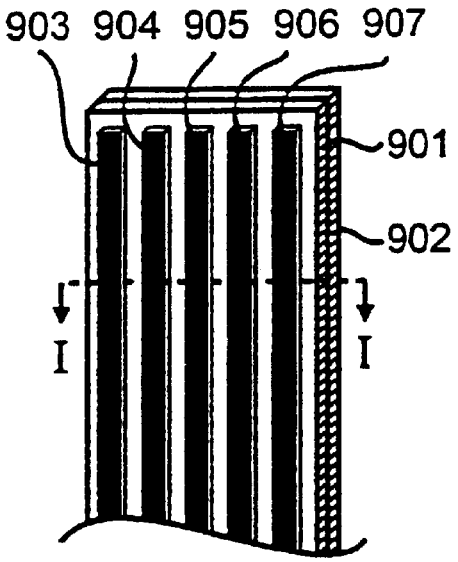
FIGS. 9*a* and 9*b* shows different views of a connector member according to a fifth embodiment of the invention.
Figure 9B:
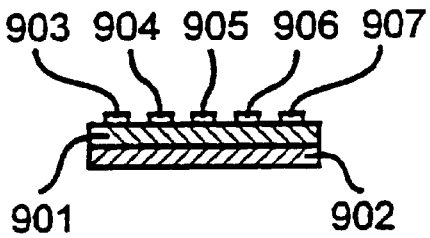

FIG. 9*a* shows a front view of an arrangement with elongated conductive strips disclosed in FIGS. 3 and 12, and FIG. 9*b* shows a view taken at I—I. A dielectric medium or carrier is denoted 901 and a conductive sheet is denoted 902. The conductive sheet 902 being coupled to ground. First, second, third, fourth and fifth elongated conductive members are mounted on the dielectric carrier 901 and denoted 903, 904, 905, 906 and 907.

Figure 10A:
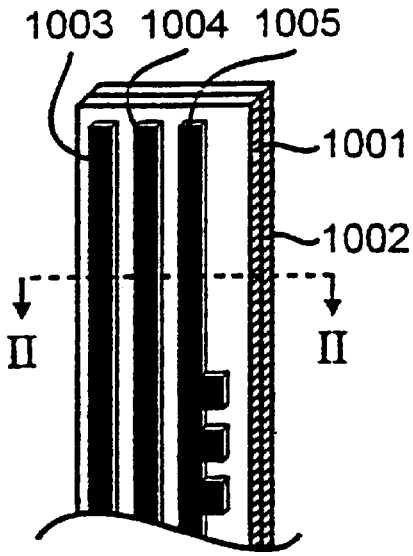
FIGS. 10*a* and 10*b* shows different views of a connector member according to a sixth embodiment of the invention.
Figure 10B:
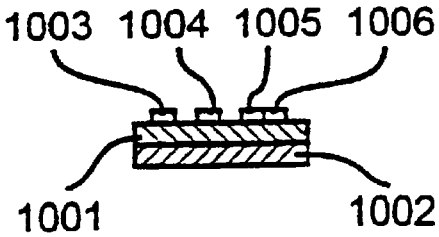

FIG. 10*a* shows a front view according to another embodiment of said elongated conductive strips and FIG. 10*b* shows the arrangement of FIG. 10*a* taken at line II—II. A dielectric medium is denoted 1001 and a conductive sheet is denoted 1002. The conductive sheet 1002 is coupled to ground. First, second and third elongated conductive strips are denoted 1003, 1004 and 1005 respectively. The third elongated strip 1005 has protrusions 1006 the adjust the electrical length of the third elongated conductive strip 1005.

Figure 11:
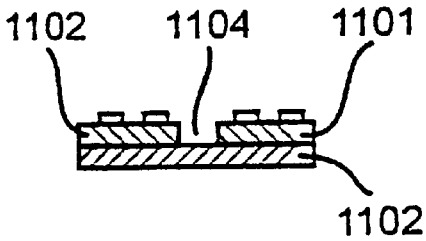
FIG. 11 shows a view of a connector member according to a seventh embodiment of the invention, FIG. 12 schematically shows an exploded view according to a preferred embodiment of the invention.

FIG. 11 shows the elongated conductive strips according to another embodiment. A first dielectric medium or carrier is denoted 1101, a second dielectric medium or carrier is denoted 1102 and a ground plane is denoted 1103. The first and second dielectric carriers are arranged with a small distance so that a recess 1104 is achieved where a first connector member (not shown), electrically connected to radiating means (not shown), may electrically couple to said ground plane 1103.

It is of course also possible to combine different aspects of the different embodiments to achieve a multiple of new slightly different embodiments. These slightly new embodiments are also intended to be included in the conceptual scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An antenna device for receiving and transmitting RF signals to and from a first circuitry arranged in a radio communication device comprising a radiating means where said radiating means being movable between a first retracted position and a second extended position, at least a first support unit and a feeding arrangement characterized in, said feeding arrangement comprising at least two first connection members (306, 307, 308; 801, 802, 803) electrically coupled to and movable with said radiating means, said feeding arrangement further comprising at least two second connection members (309, 310; 903, 904, 905, 906, 907; 1003, 1004, 1005) arranged for being electrically coupled to said first circuitry and fixedly mounted on said first support unit, said first and second connection members together forming a transmission line, and said first connection members being electrically coupled to said second connection members in all positions between and including said first and second position.

2. The antenna device according to claim 1, wherein said second connection members are an elongated conductive strip having a first open end, said second connection members having a second end connectable to said first circuitry, said first connection members being coupled to said second connection members in said first end when said radiating means being in said first position and, said first connection members being coupled to said second connection members in said second end when said radiating means being in said second position.

3. The antenna device according to claim 2, wherein said radiating means comprising means for dividing and combining received and transmitted RF signals, a first elongated conductive strip and a corresponding resilient member is arranged for conducting RF signals to be transmitted by the radiating means from said first circuitry, a second elongated conductive strip and a corresponding resilient member is arranged for conducting RF signals received by the radiating means to said first circuitry, a third elongated conductive strip is arranged between said first and second elongated conductive strips and is connected to ground.

4. The antenna device according to claim 1, wherein said first connection members comprising a multitude of resilient conductive members, said second connection members comprising a multitude of elongated conductive strips arranged on one side of a dielectric medium and with a ground plane arranged on an opposite side of said dielectric medium, each resilient conductive member of said multitude of conductive members being arranged to exert a force against a corresponding elongated conductive strip so as to enable electrical coupling between said conductive member and said conductive strip and, each resilient conductive member being arranged to slide along said elongated conductive strip when said radiating means moves between said first and second position.

5. The antenna device according to claim 4, wherein at least one of said multitude of elongated conductive strips being coupled to ground.

6. The antenna device according to claim 4, wherein said dielectric medium having at least one recess so as to enable a corresponding resilient conductive member to electrically couple to said ground plane.

7. The antenna device according to claim 4, wherein at least one of said elongated conductive strips having irregular shaped edges, said irregular shaped edges being adjusted so that the elongated conductive strip having an input impedance seen from a first point where the resilient conductive member connects to the elongated conductive strip and towards said open end which is very large compared to the input impedance seen from said first point and towards the radiating means.

8. The antenna device according to claim 7, wherein said first point being said second end.

9. The antenna device according to claim 1, wherein said radiating means comprising a first radiating structure arranged for transmitting and receiving circular polarized RF signals and, a second radiating structure arranged for receiving and transmitting RF signals.

10. The antenna device according to claim 9, wherein said first radiating structure being arranged for receiving and transmitting RF signals to and from a satellite, and where said second radiating structure being arranged for receiving and transmitting RF signals in a ground based system.

11. The antenna device according to claim 9, wherein said radiating means comprising means for dividing and combining received,and transmitted RF signals, a first elongated conductive strip and a corresponding resilient member is arranged for conducting RF signals to be transmitted by said first radiating structure from said first circuitry, a second elongated conductive strip and a corresponding resilient member is arranged for conducting RF signals received by said first radiating structure to said first circuitry, a third elongated conductive strip and a corresponding resilient member is arranged for conducting RF signals to be transmitted by said second radiating structure from said first circuitry, a fourth elongated conductive strip and a corresponding resilient member is arranged for conducting RF signals received by said second radiating structure to said first circuitry and, elongated conductive strips connected to ground being arranged between at least one pair of said first, second, third and fourth elongated conductive strips.

12. The antenna device according to claim 11, wherein at least a second circuitry being arranged on said radiating means, further elongated conductive strips and corresponding resilient members in said multitude being arranged for feeding power and control signals to said second circuitry.

13. The antenna device according to claim 12, wherein said second circuitry comprising low noise amplifiers, phasing networks, couplers, diplexers or duplexers.

* * * * *